US006239540B1

(12) United States Patent
Wittmann

(10) Patent No.: US 6,239,540 B1
(45) **Date of Patent: *May 29, 2001**

(54) COMPACT LOW PRESSURE DISCHARGE LAMP HAVING SPRING ELEMENT TO CONNECT THE SUPPLY LEADS OF THE LAMP TO THE ELECTRIC TERMINALS OF THE MOUNTING PLATE

(75) Inventor: Horst Wittmann, Stadtbergen (DE)

(73) Assignee: Patent-Treuhand-Gesselschaft fuer elektrische Gluehlampen mbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/207,866

(22) Filed: Dec. 8, 1998

(30) Foreign Application Priority Data

Dec. 11, 1997 (DE) ..... 197 55 171

(51) Int. Cl.[7] ..... H01J 5/48; H01J 5/50

(52) U.S. Cl. ..... 313/318.09; 313/318.01; 313/318.12; 313/493; 313/634

(58) Field of Search ..... 313/318.01, 318.03, 313/318.04, 318.05, 318.06, 318.09, 318.1, 318.12, 492, 493, 631, 632, 634, 217; 439/180, 620, 236

(56) References Cited

U.S. PATENT DOCUMENTS 5,627,433 * 5/1997 Fulop et al. ..... 315/56
6,011,347 * 1/2000 Wittmann ..... 313/318.09
6,075,318 * 6/2000 Noll et al. ..... 313/573
6,089,887 * 7/2000 Ozaki ..... 439/139

FOREIGN PATENT DOCUMENTS 0 452 743 B1 4/1991 (DE) .

* cited by examiner

*Primary Examiner*—Vip Patel
*Assistant Examiner*—Karabi Guharay
(74) *Attorney, Agent, or Firm*—Carlo S. Bessone

(57) ABSTRACT

The present invention relates to a compact low-pressure discharge lamp comprising a discharge vessel (14) with electrodes and supply leads (30), and a base (12) assembled from a cap (16), housing (18) and mounting plate (24) with a ballast arrangement. The mounting plate (24) with the ballast arrangement is installed in the interior of the base housing (30) and has terminals (26) for the electric connection of the supply leads (30) to the mounting plate (24). In this case, the supply leads (30) are pressed against the electric terminals (26) of the mounting plate (24) by means of a spring element (28).

15 Claims, 2 Drawing Sheets

COMPACT LOW PRESSURE DISCHARGE LAMP HAVING SPRING ELEMENT TO CONNECT THE SUPPLY LEADS OF THE LAMP TO THE ELECTRIC TERMINALS OF THE MOUNTING PLATE

FIELD OF THE INVENTION

The invention relates to a compact low-pressure discharge lamp comprising a discharge vessel with electrodes and supply leads, and a base assembled from a cap, housing and mounting plate with a ballast arrangement, the mounting plate with the ballast arrangement being installed in the interior of the base housing and having terminals for the electric connection of the supply leads to the mounting plate.

BACKGROUND OF THE INVENTION

Known low-pressure discharge lamps are increasingly replacing the incandescent lamp in the domestic sector. In the known low-pressure discharge lamps, the discharge vessel mostly consists of a singly or multiply bent tube which is arranged in a base. In this arrangement, a mounting plate constructed as a printed circuit board and on which an electronic ballast arrangement is soldered, is integrated in the base. The production costs for these compact low-pressure discharge lamps are relatively high, since many complicated fabrication steps are required in the production. One of these fabrication steps is making the electric connection between the supply leads of the discharge vessel and the corresponding terminals of the ballast arrangement. To date, the appropriate connecting wires have been brought together and, for example, crimped with a metal sleeve in order to produce this connection. A development of this simple connection is described in EP-A-0 452 743. This printed publication discloses a low-pressure discharge lamp of the type mentioned at the beginning which has holding pins with the aid of which the ends of the supply leads are aligned perpendicular to the U-shaped connecting wires of the ballast arrangement. During the assembly of the base housing and mounting plate with the base cap, the respective wires with which contact is to be made are arranged one behind another approximately at a right angle and pressed resiliently against one another with the aid of the holding pin and the inner wall of the base housing so that an electric connection is produced between the electrodes of the discharge vessel of the ballast arrangement.

A disadvantage of this prior art is that such an electrical connecting system is very complicated. This increases the production costs. Moreover, because it is necessary to ensure that the elements make contact reliably, the rate of production is not very high for such low-pressure discharge lamps.

SUMMARY OF THE INVENTION

It is therefore the object of the invention to provide a compact low-pressure discharge lamp of the type mentioned at the beginning, in which the design required for electrically connecting the supply leads of the discharge vessel to the corresponding terminals of the ballast arrangement can be produced simply, quickly and cost-effectively while ensuring optimum contact making.

The features of the independent claim serve to achieve this object.

Advantageous embodiments are described in the subclaims.

In a compact low-pressure discharge lamp according to the invention, the supply leads of a discharge vessel are connected to the electrical terminals of a mounting plate with a ballast arrangement via a spring element in each case, which presses the supply lead against the terminal. Using a spring element which exerts pressure on the supply lead, ensures reliable contact is made. Consequently, according to the invention, in an advantageous way, only one element is required to connect the supply leads of the discharge vessel to the corresponding terminals of the mounting plate and/or of the ballast. There is a consequent substantial reduction in the production costs. In addition, a substantial increase in the rate of production advantageously results, since when the base of the low-pressure discharge lamp is assembled, the base housing and base cap need only be pressed on to one another.

According to the invention, before the assembly of the base the spring element is held in a spring receptacle constructed on the inner circumference of the cap. For this purpose, the spring receptacle has a cavity for holding at least a part of the spring element, and is usually constructed with a rectangular cross section. As a result, the spring elements can be mounted independently of the final mounting of the lamp, and this contributes to simplifying the production process, and thereby lowers the production costs.

In a further advantageous embodiment of the low-pressure discharge lamp according to the invention, a shoulder for supporting a region of the spring element is constructed in the cavity of the spring receptacle. In addition, a gap for holding one end of the supply lead is constructed between the inner circumference of the housing and the outer circumference of the cap. According to the invention, these features also contribute to simplifying the production process of the lamp.

In a further advantageous embodiment of the subject matter of the invention, the supply lead and the spring element and the terminal of the mounting plate are constructed in one piece. Since the number of required elements is reduced in this case, it is further possible to simplify the production process. In a further advantageous embodiment of the low-pressure discharge lamp according to the invention, the mounting plate is fastened in the interior of the housing perpendicular to the longitudinal axis of the lamp. In this case, the mounting plate is situated on ribs constructed on the inner circumference of the housing and extending parallel to the longitudinal axis of the lamp. In an advantageous way, the mounting plate is constructed as a printed circuit board, conductor tracks being constructed on the side facing the discharge vessel, and circuit elements of the ballast arrangement being constructed on the side averted from the discharge vessel. In this case, at least one terminal is constructed as a soldering eyelet for making electric contact between the supply leads and the mounting plate. In a further advantageous embodiment, at least one terminal for making electric contact between the supply lead and the mounting plate consists of one or more flat soldering surfaces and/or strips. This simple and space saving design of the lamp base ensures that the latter can be kept small overall and can also be produced cost-effectively.

It is advantageous to construct positioning devices for correctly positioning the cap and the housing of the base.

BRIEF DESCRIPTION OF THE DRAWINGS

Further details, features, configurations and advantages are yielded by the following description of a plurality of exemplary embodiments, represented in drawings, of the subject matter of the invention. In the drawing.

BEST MODE FOR CARRYING OUT THE INVENTION

Figure 1:
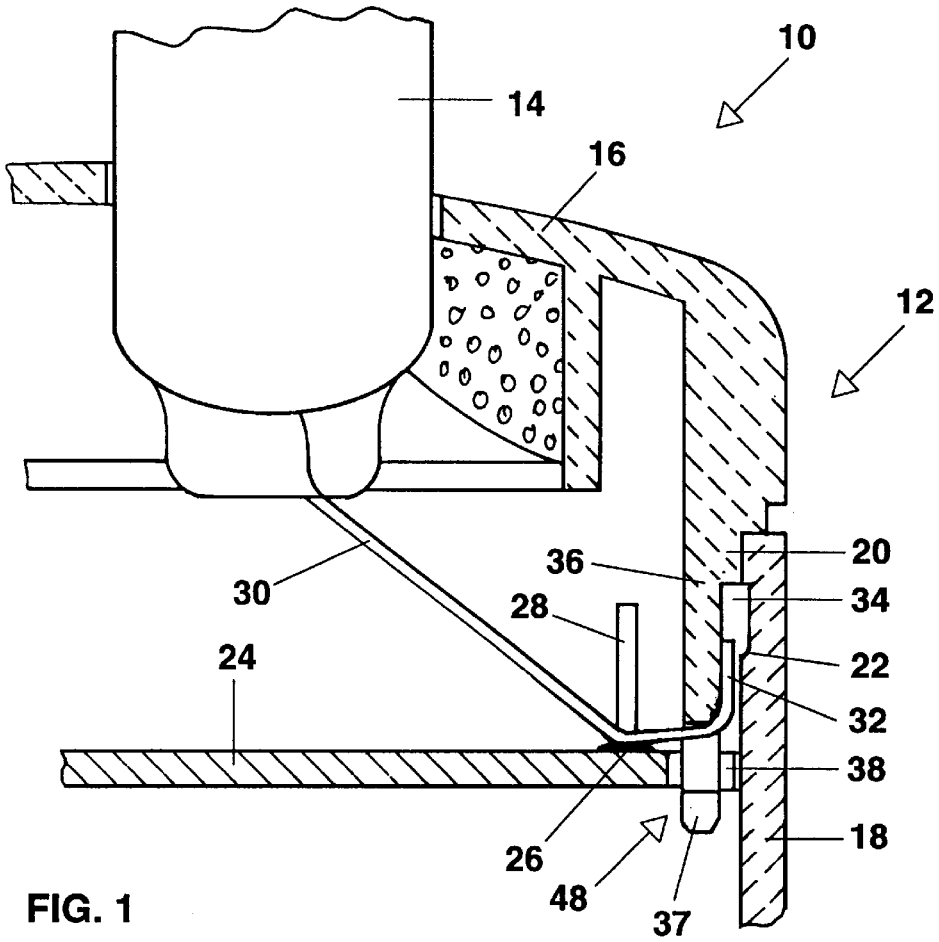
FIG. 1 shows a diagrammatically represented, lateral sectional view of the low-pressure discharge lamp according to the invention.
Figure 2:
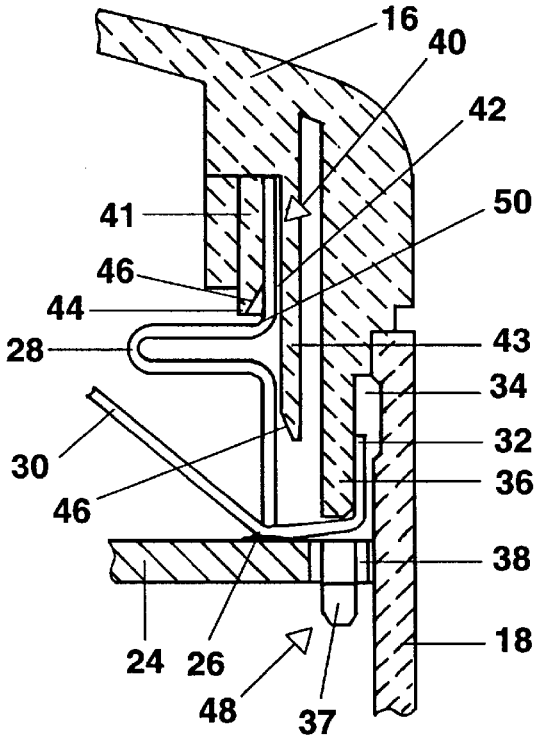
FIG. 2 shows a diagrammatically represented sectional drawing of the edge region of the cap of the low-pressure discharge lamp according to the invention.

FIG. 1 and FIG. 2 respectively reproduce a diagrammatically represented sectional view of a compact low-pressure discharge lamp 10 according to the invention and a subregion of the edge region of the base 12. The lamp 10 comprises here a discharge vessel 14 and a base 12, the base 12 being assembled from a cap 16 and a housing 18. The base 12 is essentially of cylindrical construction here. The cap 16 and the housing 18 are detachably interconnected, at least one positioning device 48 for connecting the cap 16 and housing 18 at the correct position being constructed. In this case, the cap 16 has in the end facing the housing 18 an annular bead 20 in its outer circumference. The bead 20 and an annular groove 22 in the inner circumference of the housing 18 form a gap 34 for holding an end 32 of a supply lead 30.

A mounting plate 24 is fastened perpendicularly to the longitudinal axis of the lamp in the interior of the housing 18 which is essentially of cylindrical construction. The mounting plate 24 is constructed as a printed circuit board, conductor tracks being constructed on the side facing the discharge vessel 14, and circuit elements of the ballast arrangement (not represented) being constructed on the side averted from the discharge vessel 14.

The discharge vessel 14 usually comprises two or three tube lengths bent in the shape of a U which are connected to one another by a passage (not represented), the end limbs carrying electrodes in each case. The free ends of the tube lengths are sealed in a gastight fashion by pinches and are seated inside the cap 16 of the base 12. The supply leads 30 emerge from the discharge vessel 14 in the region of the pinches. The supply leads 30 are pressed against the electric terminals 26 of the mounting plate 24 by means of a spring element 28. In this case, the spring element 28 engages in a spring receptacle 40 constructed in the region of the inner circumference of the cap 16 and, in the exemplary embodiment shown, is detachably fastened therein. The spring receptacle 40 comprises side walls 41, 43 which surround a cavity 42. The cavity 42 serves to hold a part of the spring element 28, and is of rectangular cross section.

A shoulder 44 for supporting a region 50 of the spring element 28 is constructed in the cavity 42. The side walls 41, 43 surrounding the cavity 42 have bevels 46 towards the free end of the spring receptacle 40. These bevels 46 facilitate the introduction of the spring element 28. In addition, when the lamp 10 is being mounted and/or when the base 12 is being assembled, the end 32 of the supply lead 30 is laid into the gap 34 and thus aligned in the correct position.

On the side facing the discharge vessel 14, the mounting plate 24 has terminals 26 for making electric contact with the supply leads 30 of the ballast arrangement. The terminals 26 can be constructed in this case as soldering eyelets, or as flat soldering surfaces and/or soldering strips which are integrated into the mounting plate 24 or situated thereupon.

FIG. 2 shows a sectional view of a subregion of the edge region of the base 12. It is to be seen that the free end of the housing 18 is connected to the free end of the cap 16. The spring receptacle 40 is constructed in the region of the inner circumference of the cap 16. The side walls 41, 43 surround the cavity 42 in which the shoulder 44 is constructed on the side facing the outer circumference of the cap 16. The spring receptacle 40 is constructed in this case with an essentially rectangular cross section. The bevel 46 of the side walls 41, 43 is also to be seen. Again, the different overall lengths of the two side walls 41, 43 is in evidence.

A circumferential lug 36 forms the termination of the cap 16 in the direction of the mounting plate 24. The lug 36 in this case forms thorn-like projections 37 at predetermined points, which engage in corresponding cutouts 38 in the mounting plate 24. The thorn-like projections 37 of the lug 36 and the cutouts 38 thereby form the positioning device 48.

Figure 3:
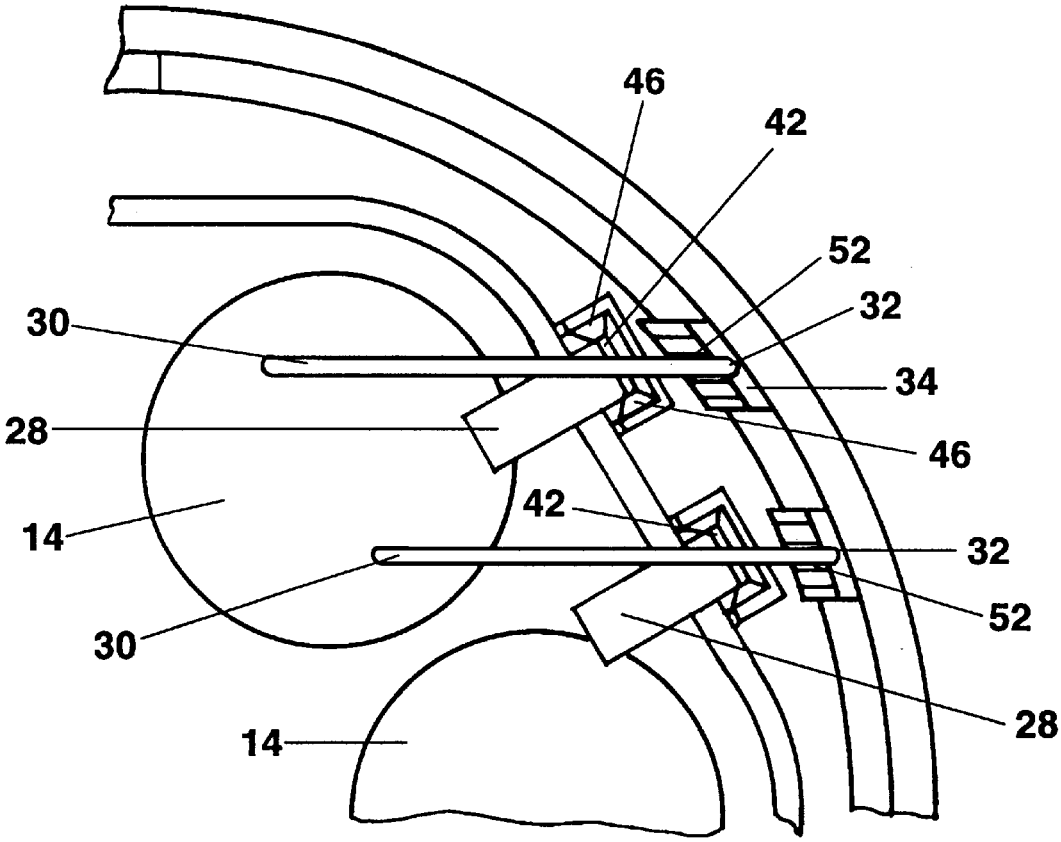
FIG. 3 shows a diagrammatically represented plan view of a part of the edge region of the base of the low-pressure discharge lamp according to the invention.

FIG. 3 shows a view of a part of the edge region of the base 12 of the lamp 10. It is to be seen that the ends 32 of the supply leads 30 come to be situated in the gap 34 formed between the circumferential lug 36 and the inner circumference of the housing 18. Cutouts 52 for holding the ends 32 of the supply leads 30 are constructed in each case on the outer circumference of the cap 16 in the region of the spring receptacles 40 for the purpose of correctly positioning the supply leads 30 below the spring element 28.

Figure 4:
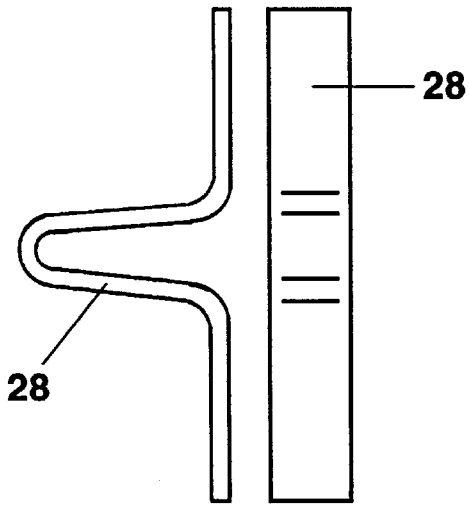
FIG. 4 shows diagrammatically represented side views of the spring element of the low-pressure discharge lamp according to the invention.

FIG. 4 shows a diagrammatic representation of the construction of the spring element 28. The spring element 28 is represented in this case as a multiply bent spring steel strip. The length of the spring element 28 is selected so as to ensure reliable contact between the supply lead 30 and the terminal 26 of the mounting plate 24. The spring element 28 consists of plastic and/or metal and/or a metal alloy.

In a further exemplary embodiment (not represented), the spring element can be constructed as a spiral spring. Any other advantageous shape of the spring is also conceivable.

In a further exemplary embodiment (not represented), it is provided that the supply lead 30 and the spring element 28 are constructed in one piece.

What is claimed is:

1. A compact low-pressure discharge lamp comprising a discharge vessel (14) with electrodes and supply leads (30), and a base (12) assembled from a cap (16), housing (18) and mounting plate (24) with a ballast arrangement, the mounting plate (24) with the ballast arrangement being installed in the interior of the base housing (18) and having terminals (26) for the electric connection of the supply leads (30) to the mounting plate (24), wherein the supply leads (30) are pressed against the electric terminals (26) of the mounting plate (24) by means of a spring element (28).

2. The low-pressure discharge lamp as claimed in claim 1, wherein the cap (16) has at least one spring receptacle (40) for receiving and detachably fastening the spring element (28).

3. The low-pressure discharge lamp as claimed in claim 2, wherein the spring receptacle (40) is constructed in the region of the inner circumference of the cap (16).

4. The low-pressure discharge lamp as claimed in claim 2, wherein the spring receptacle (40) has a cavity (42) for holding a part of the spring element (28) and is constructed with a rectangular cross section.

5. The low-pressure discharge lamp as claimed in claim 4, wherein a shoulder (44) for supporting a region (50) of the spring element (28) is constructed in the cavity (42).

6. The low-pressure discharge lamp as claimed in claim 4, wherein a gap (34) for holding one end (32) of the supply lead (30) is constructed between the inner circumference of the housing (18) and the outer circumference of the cap (16).

7. The low-pressure discharge lamp as claimed in claim 1, wherein the spring element (28) consists of a singly or multiply bent spring steel strip or of a spiral spring.

8. The low-pressure discharge lamp as claimed in claim 1, wherein the spring element (28) consists of plastic and/or metal and/or a metal alloy.

9. The low-pressure discharge lamp as claimed in claim 1, wherein the base (12) is essentially of cylindrical construction.

10. The low-pressure discharge lamp as claimed in claim 1, wherein the cap (16) and the housing (18) are detachably interconnected, at least one positioning device (48) for connecting the cap (16) and housing (18) at the correct position being constructed.

11. The low-pressure discharge lamp as claimed in claim 1, wherein the mounting plate (24) is fastened in the interior of the housing (18) perpendicular to the longitudinal axis of the lamp.

12. The low-pressure discharge lamp as claimed in claim 1, wherein the mounting plate (24) is constructed as a printed circuit board, conductor tracks being constructed on the side facing the discharge vessel (14), and circuit elements of the ballast arrangement being constructed on the side averted from the discharge vessel (14).

13. The low-pressure discharge lamp as claimed in claim 1, wherein at least one terminal (26) is constructed as a soldering eyelet for making electric contact between the supply leads (30) and the mounting plate (24).

14. The low-pressure discharge lamp as claimed in claim 1, wherein at least one terminal (26) for making electric contact between the supply leads (30) and the mounting plate (24) consists of one or more flat soldering surfaces and/or strips.

15. The low-pressure discharge lamp as claimed in claim 1, wherein the supply lead (30) and the spring element (28) are constructed in one piece.

* * * * *